US005510770A

United States Patent [19]

Rhoads

[11] Patent Number: 5,510,770

[45] Date of Patent: Apr. 23, 1996

[54] SURFACE DEACTIVATEABLE TAG

[75] Inventor: Kevin G. Rhoads, Andover, Mass.

[73] Assignee: Checkpoint Systems, Inc., Thorofare, N.J.

[21] Appl. No.: 220,089

[22] Filed: Mar. 30, 1994

[51] Int. Cl.[6] ..... G08B 13/187

[52] U.S. Cl. ..... 340/572

[58] Field of Search ..... 340/572

[56] References Cited

U.S. PATENT DOCUMENTS

| | | | |
|---|---|---|---|
| 3,624,631 | 11/1971 | Chomet et al. | 340/572 |
| 3,810,147 | 5/1974 | Lichtblau | 340/572 |
| 3,863,244 | 1/1975 | Lichtblau | 340/572 |
| 4,021,705 | 5/1977 | Lichtblau | 361/402 |
| 4,498,076 | 2/1985 | Lichtblau | 340/572 |
| 4,567,473 | 1/1986 | Lichtblau | 340/572 |
| 5,081,445 | 1/1992 | Gill et al. | 340/572 |
| 5,103,210 | 4/1992 | Rode et al. | 340/572 |
| 5,172,461 | 12/1992 | Pichl | 340/572 |
| 5,367,290 | 11/1994 | Kind et al. | 340/572 |

FOREIGN PATENT DOCUMENTS

WO94/12957 6/1994 WIPO .

*Primary Examiner*—Glen Swann

*Attorney, Agent, or Firm*—Panitch Schwarze Jacobs & Nadel

[57] ABSTRACT

A security tag used with an electronic security system comprises a dielectric substrate having first and second opposite principal surfaces and a resonant circuit capable of resonating at a frequency within a detection frequency range. The resonant circuit is formed, in part, by a first conductive area on the first substrate surface and a second conductive area on the second substrate surface, the two conductive areas being generally aligned with one another to establish a capacitor with the substrate therebetween forming the capacitor dielectric. A third conductive area is provided on one of the principal substrate surfaces proximate to but not electrically connected to one of the two capacitor plates. The third conductive area is electrically connected to the other capacitor plate. A portion of the third conductive area is spaced from a portion of the one capacitor plate by a predetermined minimum distance whereby upon the application of electromagnetic energy to the tag at a frequency generally corresponding to the resonant frequency of the resonant circuit and at or above a predetermined minimum energy level, an electric arc extends between the spaced portions of the third conductive area and the one capacitor plate creating a persistent conductive bridge which connects the two plates of the capacitor in a short circuit.

9 Claims, 2 Drawing Sheets

SURFACE DEACTIVATEABLE TAG

FIELD OF THE INVENTION

The present invention relates to security tags for use with electronic security systems for the detection of unauthorized removal of articles and, more particularly, to circuits for deactivateable resonant tags and methods of electronic deactivation of such tag circuits.

BACKGROUND OF THE INVENTION

The use of electronic article security systems for detecting and preventing theft or unauthorized removal of articles or goods from retail establishments and/or other facilities, such as libraries, has become widespread. In general, such security systems employ a label or security tag which is affixed to, associated with, or otherwise secured to an article or item to be protected or its packaging. Security tags may take on many different sizes, shapes, and forms, depending on the particular type of security system in use, the type and size of the article, etc. In general, such security systems are employed for detecting the presence or absence of an active security tag and, thus, a protected article as the security tag and the protected article pass through a security or surveillance zone or pass by or near a security checkpoint or surveillance station.

The security tag which is affixed to or otherwise associated with the article being secured can be implemented with a variety of technologies. More advanced tags allow for single use remote deactivation, single use remote activation, single use remote activation and deactivation, and multiple use remote activation and deactivation.

The security tags which are disclosed herein are tags which are designed to work primarily with radio frequency (RF) electromagnetic field disturbance sensing electronic security systems of the types disclosed in U.S. Pat. Nos. 3,810,147 entitled "Electronic Security System", and 3,863,244 entitled "Electronic Security System Having Improved Noise Discrimination" and their commercially available implementations and counterparts. Such electronic security systems generally establish an electromagnetic field which is provided in a controlled area through which articles must pass in leaving the controlled premises. A resonant tag circuit is attached to each article, and the presence of the tag circuit in the controlled area is sensed by a receiving system to denote the unauthorized removal of an article. The tag circuit is deactivated, detuned or removed by authorized personnel from any article authorized to leave the premises to permit passage of the article through the controlled area without alarm activation.

Removal of the tag can be difficult and time consuming and, in some cases, requires additional removal equipment and/or specialized training. Detuning the security tag by covering it with a special shielding device such as a metallized sticker is also time consuming and inefficient. Furthermore, both of these deactivation methods require the security tag to be identifiable and accessible, which prohibits the use of tags embedded within merchandise at undisclosed locations or tags concealed in or upon the packaging.

Systems are known for the remote electronic deactivation of a resonant tag circuit such that the deactivated tag can remain on an article properly leaving the premises. Electronic deactivation of a resonant security tag involves changing or destroying the detection frequency resonance so that the security tag is no longer detected as an active security tag by the security system. There are many methods available for achieving electronic deactivation. In general, the known methods involve either short circuiting a portion of the resonant circuit or creating an open circuit within some portion of the resonant circuit to either spoil the Q of the circuit or shift the resonant frequency out of the frequency range of the detection system or both.

One such system is shown in U.S. Pat. No. 3,624,631 in which a fusible link in series with an inductor of the resonant circuit is burned out by the application of energy higher than that employed for detection to deactivate the tuned circuit. Another electronic security system shown in U.S. Pat. No. 3,810,147 employs a resonant circuit having two distinct frequencies, one for detection and one for deactivation. A small fusible link is provided in the deactivation circuit which also includes a second capacitor to provide a distinct deactivation resonant frequency.

Deactivateable security tags are also disclosed in U.S. Pat. Nos. 4,498,076 entitled "Resonant Tag and Deactivator for Use in Electronic Security System" and 4,567,473 entitled "Resonant Tag and Deactivator for Use in Electronic Security System". In one embodiment of these deactivateable security tags, deactivation is accomplished by shorting the tag's resonant circuit using a weak link created by forming an indentation in the tag so as to bring more closely together the metallizations of two different parts of the tag's resonant circuit on opposite sides of the tag substrate and thereby allow electrical breakdown at moderate power levels. Such a breakdown can reliably lead to the formation of a permanent (i.e., not spontaneously reversible) short circuit between the two metallizations. The usual embodiment is to have the indentation within the portion of the security tag which is used as the capacitor of the resonant circuit. Deactivateable security tags of the type disclosed in U.S. Pat. Nos. 4,498,076 and 4,567,473 have been shown to be effective and can be conveniently deactivated at a checkout counter or other such location by being momentarily placed above or near a deactivation device which subjects the tag to electromagnetic energy at a power level sufficient to cause one or more components of the security tag's resonant circuit to either short circuit or open, depending upon the detailed structure of the tag.

Each of the deactivateable security tags disclosed in the patents referenced above requires that a predetermined portion of the tag circuit, structure, substrate or some circuit component be weakened in order to establish a specific area for the tag to short circuit or open circuit upon deactivation, and to allow deactivation at moderate to low power levels. Such weakening generally requires one or more additional steps in the manufacturing process, and may also require the introduction of additional components and/or materials. The present invention comprises an improved deactivateable security tag the manufacture of which does not necessitate any additional steps in the manufacturing process nor the introduction of any additional components or materials beyond those which are needed to make a non-deactivateable security tag. The present invention comprises ways of achieving deactivateability by improvements to the metallization patterns created during manufacture, which allow for moderate to low power remote electronic deactivation of the security tag.

SUMMARY OF THE INVENTION

Briefly stated, the present invention comprises a security tag for use with an electronic security system, the system having means for detecting the presence of a security tag within a surveilled area utilizing electromagnetic energy oscillating at a frequency within a predetermined detection frequency range and means for remote electronic deactivation of the security tag using electromagnetic energy at an energy level higher than that used for detecting the presence of the tag. The security tag comprises a dielectric substrate having first and second opposite principal surfaces and a resonant circuit capable of resonating at a frequency within the detection frequency range. The resonant circuit is formed in part by a first conductive area on the first substrate surface and a second conductive area on the second substrate surface, the two conductive areas being generally aligned with each other to establish a capacitor. In establishing the capacitor, the two conductive areas form the capacitor plates and that portion of the substrate which separates the two conductive areas forms the capacitor dielectric. The capacitor, in combination with at least one other circuit component, establishes the resonant frequency of the resonant circuit. A third conductive area is provided on one of the principal substrate surfaces proximate to but not electrically connected to one of the capacitor plates on the one principal substrate surface. The third conductive area is electrically connected to the other capacitor plate. A portion of the third conductive area is spaced from a portion of the one capacitor plate by a predetermined minimum distance. Upon the application of electromagnetic energy to the tag at a frequency generally corresponding to the resonant frequency of the resonant circuit at or above a predetermined minimum energy level creates an electric arc which extends between the spaced portion of the third conductive area and the one capacitor plate. The electric arc creates a persistent conductive bridge between the third conductive area and the one capacitor plate to electrically connect the two plates of the capacitor in a short circuit and to thereby remove the capacitor from the resonant circuit. Removal of the capacitor from the resonant circuit changes the resonant frequency of the resonant circuit to a frequency outside of the detection frequency range.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred, it being understood, however, that the invention is not limited to the precise arrangement and instrumentalities disclosed. In the drawings.

DETAILED DESCRIPTION OF PREFERRED EMBODIMENTS

Figure 1:
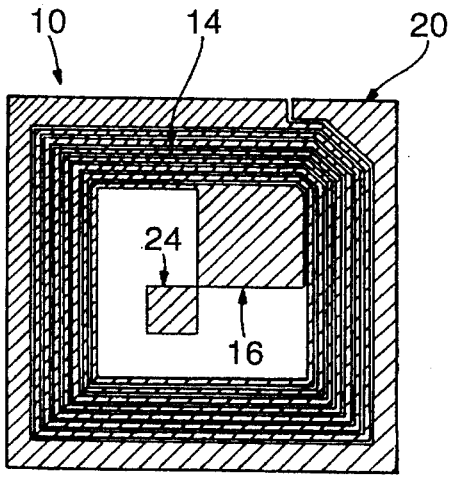
FIG. 1 is a top plan view of a first preferred embodiment of a printed circuit security tag in accordance with the present invention.
Figure 2:
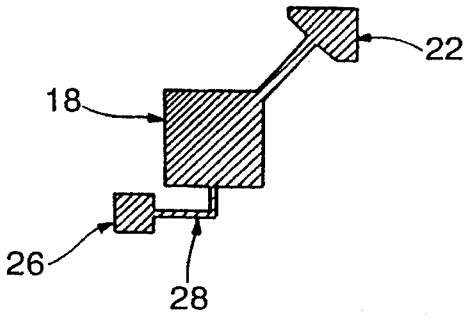
FIG. 2 is a bottom plan view of the security tag as shown in FIG. 1.

Referring to the drawing, wherein the same reference numeral designations are applied to corresponding elements throughout the several figures, there is shown in FIGS. 1 and 2 a preferred embodiment of a security tag or tag 10 in accordance with the present invention. With certain exceptions hereinafter described, the tag 10 is generally of a type which is well known in the art of electronic article security systems. As is also well known in the art, the tag 10 is adapted to be secured or otherwise borne by an article or item of personal property, or the packaging of such article (not shown) for which security or surveillance is sought. The tag 10 may be secured to the article or its packaging at a retail or other such facility, or may be secured or incorporated into the article or its packaging, by the manufacturer or wholesaler of the article.

The tag 10 is employed in connection with an electronic article security system, particularly an electronic article security system of the radio frequency or RF type. Such electronic article security systems are well known in the art and, therefore, a complete description of the structure and operation of such electronic article security systems is not necessary for an understanding of the present invention. Suffice it to say that such electronic article security systems establish a surveilled area or zone, generally proximate to an entrance or exit of a facility, such as a retail store. The security system's function is to detect the presence within the surveilled zone of an article having an active security tag secured thereto or secured to the corresponding packaging.

In the case of the present embodiment, the security tag 10 includes components, hereinafter described in greater detail, which establish a resonant circuit which resonates when exposed to electromagnetic energy at or near a resonant frequency determined by the tag components which form the resonant circuit. Typically, electronic article security systems with which the tag 10 are employed include means for transmitting into or through the surveillance zone electromagnetic energy at or near the resonant frequency of the security tag 10 and means for detecting a field disturbance that the presence of an active security tag resonating circuit causes to establish the presence of a security tag 10, and thus a protected article, within the surveillance zone.

In its preferred embodiment, the tag 10 is comprised of a generally flat insulative or dielectric substrate 12 typically formed of a polymeric material such as polyethylene, with conductive areas defining circuit elements positioned on both of the principal surfaces of the substrate 12. The tag 10 is preferredly manufactured by processes described in U.S. Pat. No. 3,913,219 entitled "Planar Circuit Fabrication Process"; however other manufacturing processes can be used, and nearly any method or process of manufacturing circuit boards could be used to make the tag 10. The substrate material may be any solid material or composite structure of materials providing that it is insulative and can be used as a dielectric.

Circuit elements and circuits are formed on both principal surfaces of the substrate 12 by patterning conductive material. In the preferred embodiment, the conductive material is aluminum and is patterned by a subtractive process, etching, whereby unwanted material is removed by chemical attack after desired material has been protected, typically with a printed on etch resistant ink. However, it is obvious that substitution of other conductive materials (e.g., gold, nickel, copper, phosphor bronzes, brasses, solders, high density graphite or silver-filled conductive epoxies) does not change the nature of the resonant circuit or its operation.

In the preferred embodiment, the resonant circuit is formed by the combination of a single inductive element, inductor or coil and a single capacitive element or capacitor connected in series. It will, of course, be appreciated that the resonant circuit may be formed by many other combinations of circuit elements or components combined in many other circuit topologies. In particular, although most presently deployed commercial electronic security systems are designed to work with frequencies in the lower RF range, typically 8.2 megaHertz and 9.5 megaHertz; UHF and microwave frequencies have also been proposed. For a UHF or microwave implementation one would most likely substitute a transmission line resonator or resonant cavity for the inductor-capacitor series circuit described above. Deactivateability would still be achieved by bridging, in parallel, two portions of the metallizations making up the resonant circuit with a surface breakdown element as hereinafter described.

In the embodiment illustrated in FIGS. 1 and 2, the inductive element is formed as a spiral coil 14 of conductive material on one principal surface of the substrate 12, which surface is arbitrarily selected as the top surface of the tag 10. The capacitor is formed by a generally parallel, aligned pair of conductive areas or plates 16, 18, with one of the plates of each pair being formed on a different principal surface of the substrate 12 so the substrate forms the dielectric for the capacitor. The top plate 16 of the capacitor is connected to one end of the spiral coil 14. A metallization area 20 on the top surface of the substrate 12 is connected to the other end of the coil 14. Another metallization area 22 on the bottom surface is connected to the bottom capacitor plate 18. A weld through the substrate (not shown) is made in the upper right corner, as depicted in FIG. 1, to electrically connect the parallel metallization areas 20, on the top surface, and 22, on the bottom surface, to establish the series connection of the inductor and the capacitor.

The tag 10 as thus far described is typical of security tags which are well known in the electronic security and surveillance art and have been in general usage. In forming such security tags the area of the coil 14 and the areas and overlap of the capacitor plates 16 and 18 are carefully selected so that the resonant circuit formed thereby has a predetermined resonant frequency which generally corresponds to or approximates a detection frequency employed in an electronic article security system for which the tag 10 is designed to be employed. The tag 10 of the present embodiment has been designed to resonate at or near 8.2 megaHertz, which is one commonly employed frequency used by electronic security systems from a number of manufacturers. However, this specific frequency is not to be considered a limitation of the present invention.

It is also well known in the electronic security and surveillance art that the capability of remote deactivation of a tag is desirable and often necessary. Such deactivation typically occurs at a checkout counter when a person purchases an article with an affixed or embedded security tag 10 so that the resonant circuit no longer resonates strongly enough near the detection frequency of the electronic security system to be detected when the article passes through the surveillance zone of the electronic security system.

Various methods have been developed for deactivating security tags. Some such methods require determining the location of the security tag and physical intervention in the secured article, and cannot be accomplished remotely nor automatically, such as physically removing the security tag or covering the tag with a shielding or detuning device such as a metallized sticker. Other methods involve exposing the tag to higher energy levels to cause the creation of a new short circuit or open circuit within the tag and thus modify the tag circuit's topology and so alter its resonance characteristics. Usually such new short or open circuit is created through the agency of a weak link which is designed to reliably change in a predictable manner upon exposure to sufficient energy.

The present invention comprises a different way of deactivating a security tag 10, one which involves introducing a different kind of weak link which shorts when the security tag is exposed to a high energy electromagnetic field. Instead of introducing a foreign element as the weak link, such as a semiconductor diode, or creating a weak link in the dielectric substrate structure, such as introducing a dimple or cracks, a weak link is introduced upon a single surface of the tag 10. The new weak link promotes arcing along the surface of the tag 10 between two metallizations or components to establish a persistent short circuit which remains after the arcing is over.

Figure 3:
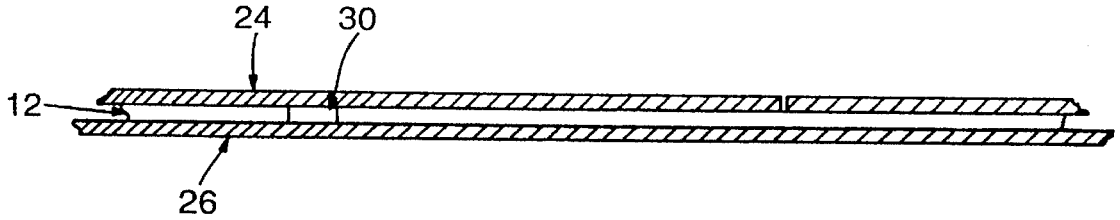
FIG. 3 is an enlarged cross-sectional view of a portion of the security tag shown in FIG. 1.

As shown in FIGS. 1 and 2, the security tag 10 further includes a further pair of generally parallel, generally aligned conductive areas or lands, 24 and 26, located on opposite principal surfaces of the substrate 12. The first conductive area 24 is located on the top surface of the substrate near, but not in direct electrical contact with, capacitor plate 16. The second conductive land 26 is located on the back surface of the substrate 12 and is electrically connected directly to capacitor plate 18 by a conductive strip 28. Conductive areas 24 and 26 are also electrically connected to each other by a weld 30 (FIG. 3) which extends completely thorough the substrate 12 and contacts or engages both conductive areas 24 and 26. Preferably, the conductive areas 24, 26 and the conductive strip 28 are formed of the same conductive material as the other components and, preferably, are formed at the same time as the above-described components utilizing the same manufacturing steps and techniques.

Figure 4:
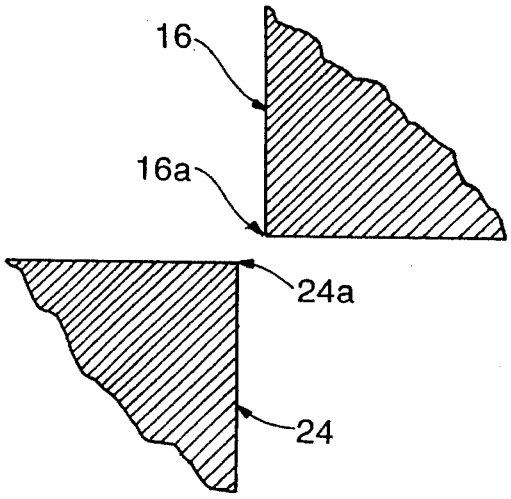
FIG. 4 is a greatly enlarged top plan view of a portion of the security tag shown in FIG. 1.

In the illustrated embodiment, conductive area 24 is shown as being generally square in plan view with intersecting lateral sides. Capacitor plate 16 is also shown as being generally square in plan view with intersecting lateral sides. Capacitor plate 16 and conductive area 24 are positioned such that their point of closest approach is where one corner of each comes close to the other. As depicted in FIGS. 1 and 4, capacitor plate 16 and conductive area 24 are aligned so that their diagonals lie generally along a single line. The exact arrangement as illustrated is not required, but there should be locally a well defined, single, path of closest approach, and large deviations from the nearly parallel diagonals aligned on a single line may fail to provide a single, locally well defined path of closest approach between the two elements. Although the use of multiple points of close approach are desirable, each behaves identically and independently, therefore the discussion henceforth is presented in terms of a single point of close approach, with the understanding that the invention is not limited to such a singular implementation. Thus, as best shown in FIG. 4, the periphery of a corner **24*a* of conductive area 24 and the periphery of a corner 16*a* of capacitor plate 16 constitute the points at which the physical distance between conductive area 24 and capacitor plate 16 is the shortest. In other words, there are no points on conductive area 24 which are closer to 35 any portion of capacitor plate 16 than point 24*a* and, similarly, there are no points on capacitor plate 16 which are closer to any portion of conductive area 24 than point 16*a*; a straight line between points 16*a* and 24*a*** is the path of closest approach.

In addition, for reasons which will hereinafter become apparent, the distance of separation of points **16*a* and 24*a***, the distance of closest approach, is preferably very small.

For operation with presently available electronic security systems, the distance of closest approach is preferably less than one mil (i.e., one thousandth (1/1000th) of an inch, being 25.4 microns in the metric system), and more preferably is less than 10 microns. It will be understood by those skilled in the art that the desired distance between points 16*a* and 24*a* will vary in particular applications. However, the distance is preferably less than or at most equal to the thickness of the substrate 12, while it must be sufficient to preclude a direct electrical connection between capacitor plate 16 and conductive area 24 under normal detection use of the security tag 10 with an electronic security system of the type with which the tag 10 is designed to work. The distance must be small enough to facilitate the bridging between the points 16*a* and 24*a* when the security tag 10 is to be deactivated as hereinafter described. It is further noted that the apparent conflict between making the distance short to facilitate bridging when deactivating and keeping it long enough to avoid spontaneous bridging at other times is a design trade-off or balance which is common to the design of any kind of weak link element (e.g., electrical fuses, circuit breakers, blasting caps, mouse trap triggers, air bag triggers, pinball table tilt sensors and the priming charges of ammunition). The weak link element must be weak enough to fail when it is intended to fail and yet strong enough to avoid failing prematurely.

When it is desired to deactivate the security tag 10, the security tag is exposed to electromagnetic energy oscillating at the frequency of the tag's resonant circuit and at a relatively high power level compared to the power level which the security tag experiences when passing through a surveillance zone of a security system. Assuming that the intensities of the electromagnetic energy are high enough, electrical breakdown, a.k.a., dielectric breakdown, is initiated and an electric arc is formed between the two points 16*a* and 24*a*. Breakdown and arcing focus between points 16*a* and 24*a* because the shortest available breakdown path is between these points. In addition, field enhancements due to geometry, particularly the so-called corner effect and edge effect resulting from the sharply curved electrode surfaces at points 16*a* and 24*a*, all foster the establishment of an electric arc between these two points. Also, of particular relevance to the described surface deactivation method, breakdown paths and electric arcs tend to follow surfaces or interfaces between materials, and the likelihood of electrical breakdown is enhanced at such surfaces and interfaces. However, it should be obvious to those skilled in the art that a number of modifications to the structures described herein will achieve the same effects of enhancing the likelihood of breakdown, lowering the voltages and energies required to initiate breakdown, and so achieve the same result as that described herein.

Figure 6:
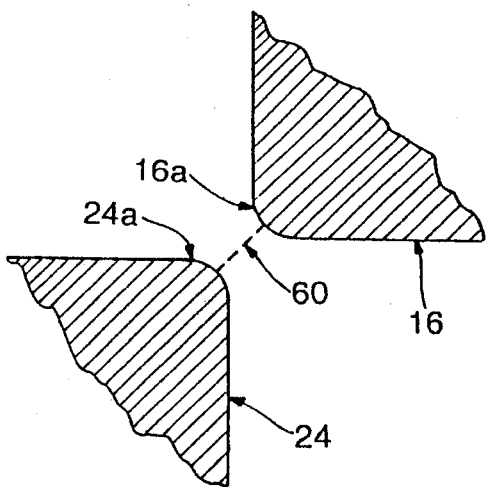
FIGS. 6, 7 and 8 are top plan views similar to FIG. 4 showing alternate preferred embodiments.

In addition to the geometrical effects upon field of electrode proximity and electrode edge curvature which result in local field enhancement over some or all of said path of closest approach, there are other means by which the likelihood of electrical breakdown may be enhanced and the voltages and energies required for initiation of electrical breakdown thereby reduced. In FIG. 6 there is shown a conductor means or structure 60 for further reducing the distance between aforementioned points 16*a* and 24*a*. The structure 60, which simultaneously enhances the likelihood of initiation of breakdown and tends to focus the resulting arc, is comprised of a single dotted or dashed line of conductive material, preferably formed of the same material and by the same patterning process as is used to form the capacitor plate 16 and conductive area 24. Because the structure 60 is intermittent it does not appreciably conduct electrical current during the electronic security system's normal sensing of the resonant tag 10. During deactivation, when the tag 10 is exposed to higher levels of electrical excitation and thus has higher amounts of electrical power resonating internally, the peak voltages between plate 16 and area 24 are higher than the peak voltages are during tag detection; at this time electrical breakdown can be initiated. The structure 60 acts 10 to guide the path of electrical breakdown and to enhance the likelihood of electrical breakdown by providing a path between plate 16 and area 24 and, in particular, between points 16*a* and 24*a* which is shorter than other possible paths. The structure 60 does so because electrically the dashes or dots of conductive material are already internally electrically connected, only those portions of the dotted or dashed line 60 which have no conductive material need be bridged by the electrical breakdown.

Figure 7:
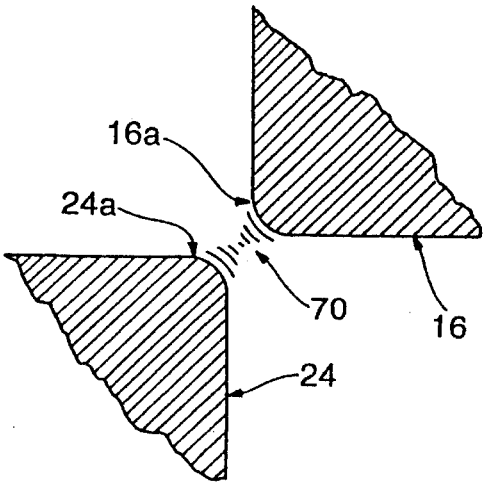
Figure 8:
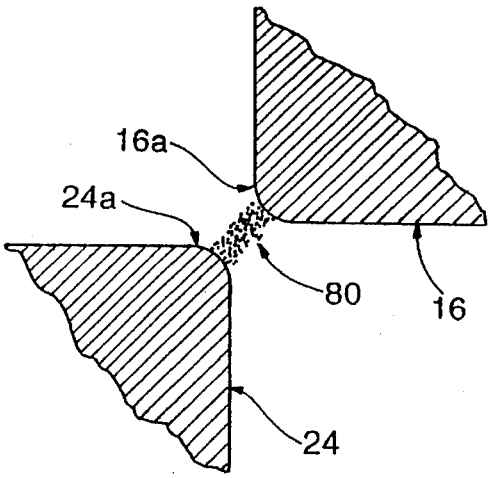

In a similar manner, the curvilinearly parallel conductive lines which make up structure 70 shown in FIG. 7 and the randomly dispersed dots forming a dot screen pattern or sprinkled dot pattern shown as structure 80 in FIG. 8 also function to focus and enhance the likelihood of electrical breakdown. All three structures, the dotted or dashed line 60, the curvilinearly parallel lines 70 and the dot screen pattern 80 also have an additional functionality in focussing electrical breakdown and enhancing its likelihood. This additional effect results from geometric field enhancement at the boundaries of the conductive regions 16, 24 which make up the structure. In the dotted or dashed line structure 60 each dot or dash has a considerable field enhancement at both ends due to the geometric field enhancement effect at sharply curved electrode surfaces. Similarly, there is enhanced field magnitudes at two opposing sides of each of the dots making the dot screen pattern of structure 80. The internal field enhancement effect is the least, and in fact can be completely eliminated by appropriate dimensioning, in the curvilinear parallel line structure 70. This allows the designer of a surface deactivation structure an additional degree of freedom in design to adjust the design for actual conditions of use and variability in the material parameters. Should the basic deactivation structure be too difficult to deactivate, additional ease in initiating breakdown and deactivation can be designed in by the addition of a breakdown guidance structure such as 60, 70 or 80. If the addition of a guidance structure makes initiation of breakdown too easy, the structure 70 can be used and its line positioning chosen to minimize field enhancement. If the addition of the guidance structure is not sufficient to ease the initiation of breakdown enough, either structure 60 or 80 can be modified either to increase the internal field enhancements and/or to decrease the distance by increasing the portion of the distance which is covered with conductive material. In summary, each structure 60, 70, 80 can be made more or less effective at increasing the likelihood of electrical breakdown and lowering the required breakdown voltage; but the range of factors of breakdown voltage reduction achievable with structure 70 is low to moderate, the range of factors of breakdown voltage reduction achievable with structures 60 and 80 are moderate to high. Thus by choice of which breakdown structure, if any, and the choice of the geometry and layout of the chosen breakdown structure, the designer of a surface breakdown deactivateable tag 10 has greater control over the behavior of a tag's deactivation properties.

Once electrical breakdown has been initiated a transient, high current, high conductivity path is established between plate 16 and area 24 which is generally referred to as an "arc" or an "electric arc" or an "arc discharge" or one of several other similar terms, and sometimes, less precisely, is referred to as a "spark discharge". The electric arc is transient, but during its existence it modifies the materials and their arrangement in its vicinity and so results in a permanent modification of the electrical resonance properties of the tag 10. Electric arcs and electrical breakdown have been intensively studied for well over a century and still are not fully understood. However, there is near universal agreement that the arc is composed of plasma, which is a highly energized and ionized gas wherein thermal equilibrium among the electrons, ionic charge carriers and neutral species usually does not obtain. Plasmas typically have core temperatures in the thousands of degrees Celsius, and contain gassified material derived not only from the substrate and/or gases upon and through which they pass but also material derived from the electrodes among which the arc passes electrical current. It is this latter characteristic which makes the arc most useful in effecting permanent modification of the properties of the tag circuit and the tag circuit's electrical resonances. By mobilizing some of the electrode material the arc can either break a connection that already exists or establish a connection where none preexisted.

Figure 5:
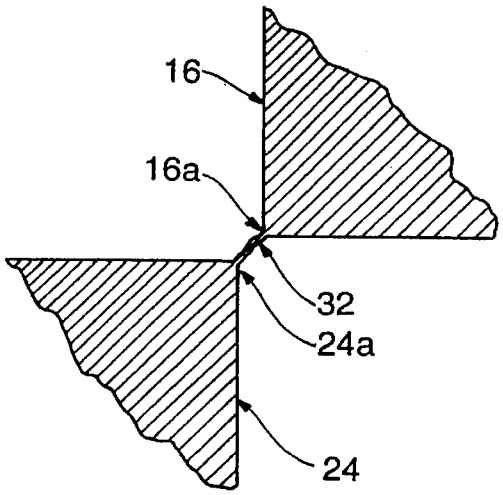
FIG. 5 is a greatly enlarged top plan view similar to FIG. 4 illustrating a deactivated security tag.

Establishment of a new electrical connection where none existed before is the primary mode applied herein. Because the arc mobilizes electrode (metallization) material in a gaseous form, and because, further, the arc is a high temperature entity which is far from in thermal equilibrium with its surroundings, there is a tendency for the arc to deposit along its pathway electrode material which the arc had carried. This results in the establishment of a metallic pathway 32 in FIG. 5 along the path the arc followed during its existence. In addition, the high temperature of the arc can char or carbonize organic materials and carbon chain polymers along its path. Finally, the arc being not merely at high temperature, but also containing ionized species and possibly also free radicals, can engage in chemical transformations of a broader character than mere charring upon the substrate. By the nature of the arc, unless there is free and unimpeded access to atmospheric oxygen, such reactions are usually reducing in character rather than oxidizing.

In any of the above cases, the initiation of electrical breakdown, and the concomitant establishment of an electrical arc, results in the production of a persistent conductive path 32 between points 16*a* and 24*a*. The conductive path 32 effectively short circuits plates 16, 18 and thereby removes the capacitor from the resonant circuit of the tag 10, and permanently deactivates the tag 10. More particularly, conductive area 24 is electrically connected by weld 30 to conductive area 26 and through conductive strip 28 to capacitor plate 18, thus the creation of the conductive bridge 32 effectively creates a short circuit between the plates 16 and 18 of the capacitor, and so effectively removes the capacitor from the tag's resonant circuit. The removal of the capacitor from the resonant circuit creates an entirely different circuit, with entirely different resonance properties; the high Q resonances that existed at or near the standard detection frequencies are destroyed. Upon the removal of the capacitor from the resonant circuit, there are no such high Q resonances at or near the standard detection frequencies, only such secondary resonances as may be induced by the interaction of remaining circuit elements and the unavoidable parasitic elements present in every circuit. Such secondary resonances are usually far from the usual detection frequencies and are most often of much lower Q than were the resonances which previously existed for detection of the active tag 10. Since any resonances which exist after deactivation are outside the range of frequencies swept by the electronic security system and are of lower Q, the tag 10 after deactivation does not appreciably interact with the electronic security system's surveillance electromagnetic field established in the system surveillance zones. Since there is no appreciable interaction between the deactivated security tag 10 and the surveillance electromagnetic field, the electronic security system does not detect the presence of the deactivated tag 10.

It will be appreciated by those skilled in the art that the actual shape of the conductive area 24, and of the capacitor plate 16, may be varied provided the corresponding portions 16*a* and 24*a* are sufficiently close together, and curved enough, to allow electrical breakdown to initiate at low enough voltage to be useable and to allow the formation of a conductive bridge 32 sufficient to short circuit the capacitor. As discussed above, the distance between the closest points of the capacitor plate 16 and the conductive area 24 may vary depending upon the resonant frequency at which the tag is deactivated, the Q of the tag at that frequency, the antenna properties of the tag (e.g., effective aperture, radiation pattern), the materials used in the construction of the tag, the thickness of the dielectric substrate 12, the detailed shapes of the capacitor plate 16 in the vicinity of point 16*a* and the conductive area 24 in the vicinity of point 24*a*, the presence or absence of additional arc guiding structures such as 60, 70 or 80, and the magnitude of power available for deactivation and the energy and voltage present in the tag during deactivation.

From the foregoing description, it can be seen that the present embodiment comprises a surface deactivateable security tag for use with an electronic security system. It will be recognized by those skilled in the art that changes may be made to the above-described embodiment of the invention without departing from the broad inventive concepts thereof. It is understood, therefore, that this invention is not limited to the particular embodiment disclosed, but is intended to cover any modifications which are within the scope and spirit of the invention as defined by the appended claims.

I claim:

1. A security tag for use with an electronic security system having means for detecting the presence of a security tag within a surveilled area utilizing electromagnetic energy oscillating at a frequency within a predetermined detection frequency range, the security system also having means for remote electronic deactivation of the security tag utilizing electromagnetic energy of an energy level higher than that used for detecting the presence of the tag, the security tag comprising:

a dielectric substrate having first and second opposite principal surfaces and a resonant circuit capable of resonating at a frequency within the detection frequency range, the resonant circuit being formed in part by a first conductive area on the first substrate surface and a second conductive area on the second substrate surface, the two conductive areas being generally aligned with one another to establish a capacitor, wherein the two conductive areas form the capacitor plates and that portion of the substrate which separates the two conductive areas forms the capacitor dielectric, the capacitor, in combination with at least one other circuit component, establishing the resonant frequency of the resonant circuit; and a third conductive area on one of the principal substrate surfaces proximate to but not electrically connected to one of the two capacitor plates on the one principal substrate surface, the third conductive area being electrically connected to the other capacitor plate, and conductor means extending between but not electrically connected to the third conductive area and the one capacitor plate, a portion of the third conductive area being spaced from a portion of the one capacitor plate by a predetermined minimum distance whereby upon the application of electromagnetic energy to the tag, at a frequency generally corresponding to the resonant frequency of the resonant circuit at or above a predetermined minimum energy level, an electric arc extends between the spaced portions of the third conductive area and the one capacitor plate creating a persistent conductive bridge therebetween to thereby electrically connect the two plates of the capacitor in a short circuit and to thereby remove the capacitor from the resonant circuit and thus change the resonant frequency of the resonant circuit to a frequency outside of the detection frequency range.

2. The security tag as recited in claim 1 wherein the third conductive area is electrically connected to the other capacitor plate by an electrical connection passing through the substrate.

3. The security tag as recited in claim 1 wherein the conductor means comprises a series of spaced apart conductors extending along a single line between the third conductive area and the one capacitor plate.

4. The security tag as recited in claim 1 wherein the conductor means comprises a series of spaced apart generally parallel conductive lines extending between the third conductive area and the one capacitor plate.

5. The security tag as recited in claim 1 wherein the conductor means comprises a series of randomly distributed conductive dots located between the third conductive area and the one capacitor plate.

6. The security tag as recited in claim 1 wherein the at least one other circuit component comprises an inductor formed of a coil on a principal surface of the substrate, the coil being electrically connected in series with the plates of the capacitor.

7. The security tag as recited in claim 1 further including a fourth conductive area on the other principal substrate surface and generally aligned with the third conductive area, the third and fourth conductive areas being electrically connected by a conductor extending through the substrate.

8. A security tag for use with an electronic security system having means for detecting the presence of a security tag within a surveilled area utilizing electromagnetic energy oscillating at a frequency within a predetermined detection frequency range, the security system also having means for remote electronic deactivation of the security tag utilizing electromagnetic energy of an energy level higher than that used for detecting the presence of the tag, the security tag comprising:

a dielectric substrate having first and second opposite principal surfaces and a resonant circuit capable of resonating at a frequency within the detection frequency range, the resonant circuit being formed in part by a first conductive area on the first substrate surface and a second conductive area on the second substrate surface, the two conductive areas being generally aligned with one another to establish a capacitor, wherein the two conductive areas form the capacitor plates and that portion of the substrate which separates the two conductive areas forms the capacitor dielectric, the capacitor, in combination with at least one other circuit component, establishing the resonant frequency of the resonant circuit; and a third conductive area on one of the principal substrate surfaces proximate to but not electrically connected to one of the two capacitor plates on the one principal substrate surface, the third conductive area being electrically connected to the other capacitor plate, a portion of the third conductive area being spaced from a portion of the one capacitor plate by a predetermined minimum distance, the third conductive area including two lateral sides which intersect at a first point and the one capacitor plate including two lateral sides which intersect at a second point, the first and second points constituting the points at which the distance between the third conductive area and the one capacitor plate is the shortest, whereby upon the application of electromagnetic energy to the tag, at a frequency generally corresponding to the resonant frequency of the resonant circuit at or above a predetermined minimum energy level, an electric arc extends between the spaced portions of the third conductive area and the one capacitor plate creating a persistent conductive bridge therebetween to thereby electrically connect the two plates of the capacitor in a short circuit and to thereby remove the capacitor from the resonant circuit and thus change the resonant frequency of the resonant circuit to a frequency outside of the detection frequency range.

9. A security tag for use with an electronic security system having means for detecting the presence of a security tag within a surveilled area utilizing electromagnetic energy oscillating at a frequency within a predetermined detection frequency range, the security system also having means for remote electronic deactivation of the security tag utilizing electromagnetic energy of an energy level higher than that used for detecting the presence of the tag, the security tag comprising:

a dielectric substrate having first and second opposite principal surfaces and a resonant circuit capable of resonating at a frequency within the detection frequency range, the resonant circuit being formed in part by a first conductive area on the first substrate surface and a second conductive area on the second substrate surface, the two conductive areas being generally aligned with one another to establish a capacitor, wherein the two conductive areas form the capacitor plates and that portion of the substrate which separates the two conductive areas forms the capacitor dielectric, the capacitor, in combination with at least one other circuit component, establishing the resonant frequency of the resonant circuit; and a third conductive area on one of the principal substrate surfaces proximate to but not electrically connected to one of the two capacitor plates on the one principal substrate surface, the third conductive area being electrically connected to the other capacitor plate, a portion of the third conductive area being spaced from a portion of the one capacitor plate by a predetermined minimum distance, the one capacitor plate being generally square in shape and the third conductive area being generally square in shape with a diagonal of the third conductive area and a diagonal of the one capacitor plate extending along a single line, whereby upon the application of electromagnetic energy to the tag, at a frequency generally corresponding to the resonant frequency of the resonant circuit at or above a predetermined minimum energy level, an electric arc extends between the spaced portions of the third conductive area and the one capacitor plate creating a persistent conductive bridge therebetween to thereby electrically connect the two plates of the capacitor in a short circuit and to thereby remove the capacitor from the resonant circuit and thus change the resonant frequency of the resonant circuit to a frequency outside of the detection frequency range.

* * * * *